US009004791B2

(12) United States Patent
Acierto et al.

(10) Patent No.: US 9,004,791 B2
(45) Date of Patent: Apr. 14, 2015

(54) PACKAGE FOR MULTIPLE PERSONAL CARE COMPOSITIONS

(75) Inventors: Gwen Sheila Trinidad Acierto, Owings Mills, MD (US); Mark Jay Barnes, Bel Air, MD (US); Christopher Louis Hansen, Loveland, OH (US); Folke Schlueter, Geneva (CH); Ian Andrew Carnduff, New York, NY (US)

(73) Assignee: The Procter & Gamble Company, Cincinnati, OH (US)

( * ) Notice: Subject to any disclaimer, the term of this patent is extended or adjusted under 35 U.S.C. 154(b) by 499 days.

(21) Appl. No.: 13/046,014

(22) Filed: Mar. 11, 2011

(65) Prior Publication Data

US 2011/0268490 A1 Nov. 3, 2011

Related U.S. Application Data

(60) Provisional application No. 61/329,753, filed on Apr. 30, 2010.

(51) Int. Cl.

| | |
|---|---|
| ***B05C 1/00*** | (2006.01) |
| ***A45D 34/04*** | (2006.01) |
| ***A45D 40/24*** | (2006.01) |
| *A45D 40/26* | (2006.01) |

(52) U.S. Cl.

CPC ..... *A45D 34/04* (2013.01); *A45D 2200/053* (2013.01); *A45D 40/24* (2013.01); *A45D 2200/056* (2013.01); *A45D 40/265* (2013.01)

(58) Field of Classification Search

USPC ..... 401/16–18, 44, 27, 126; 132/216, 218, 132/313–314

See application file for complete search history.

(56) References Cited

U.S. PATENT DOCUMENTS

| | | | | |
|---|---|---|---|---|
| 2,215,161 | A * | 9/1940 | Sapery | 132/314 |
| 2,458,063 | A * | 1/1949 | Dulberg | 132/314 |
| 2,831,854 | A | 4/1958 | Tucker | |
| 2,900,306 | A | 8/1959 | Slater | |
| 3,255,082 | A | 6/1966 | Barton | |

(Continued)

FOREIGN PATENT DOCUMENTS

| | | |
|---|---|---|
| CN | 300856708 | 12/2008 |
| CN | 300856709 | 12/2008 |

(Continued)

OTHER PUBLICATIONS

Avon, Avon Colour, In A Blink Eye Shadow and Liner, date published Mar. 2007; www.gnpd.com, 2 pages.

Avon, Avon, Blueberry Cool/Black Lush Lips and Long Lashes, date published Mar. 2006; www.gnpd.com, 2 pages.

Avon, Avon, Dual Ended Eye-Liner, date published Oct. 2007; www.gnpd.com, 2 pages.

(Continued)

*Primary Examiner* — David Walczak
*Assistant Examiner* — Jennifer C Chiang
(74) *Attorney, Agent, or Firm* — Carlos A. Garcia; John G. Powell

(57) ABSTRACT

A package for two liquid personal care compositions, including an applicator, a first reservoir, and a second reservoir. The applicator is non-removably connected at and extends away from the first cavity. The first and second reservoirs each hold a quantity of a liquid composition therein. The first reservoir includes an open end sized for independent insertion and removal of the applicator therethrough. The first reservoir is removable and protectively encases the applicator. The second reservoir includes a closed end an opposing open end, through which a liquid composition can be dispensed.

15 Claims, 2 Drawing Sheets

(56) References Cited

U.S. PATENT DOCUMENTS 3,677,271 A 7/1972 Luciano
3,690,777 A 9/1972 Costa
3,739,789 A 6/1973 Cataneo
3,802,841 A 4/1974 Robin
3,963,699 A 6/1976 Rizzi et al.
4,005,195 A 1/1977 Jandacek
4,005,196 A 1/1977 Jandacek et al.
4,126,679 A 11/1978 Davy et al.
4,137,306 A 1/1979 Rubino et al.
4,151,272 A 4/1979 Geary et al.
4,154,816 A 5/1979 Roehl et al.
D252,911 S 9/1979 Levy
4,202,879 A 5/1980 Shelton
4,226,889 A 10/1980 Yuhas
4,228,277 A 10/1980 Landoll
4,229,432 A 10/1980 Geria
4,280,994 A 7/1981 Turney
4,322,400 A 3/1982 Yuhas
4,336,246 A 6/1982 Leon-Pekarek
4,346,079 A 8/1982 Roehl
D267,822 S 2/1983 Katz
4,383,988 A 5/1983 Teng et al.
D277,324 S 1/1985 Davey
4,517,360 A 5/1985 Volpenhein
4,518,772 A 5/1985 Volpenhein
4,725,432 A 2/1988 May
4,759,924 A 7/1988 Luebbe et al.
4,797,300 A 1/1989 Jandacek et al.
4,816,261 A 3/1989 Luebbe et al.
4,886,080 A 12/1989 Cole
4,932,802 A 6/1990 Cantone
4,980,155 A 12/1990 Shah et al.
4,993,858 A 2/1991 Mock
5,017,398 A 5/1991 Jandacek et al.
5,019,375 A 5/1991 Tanner et al.
5,040,914 A 8/1991 Fitjer
5,056,179 A 10/1991 Capponi
5,097,853 A 3/1992 Nehashi
5,104,646 A 4/1992 Bolich, Jr. et al.
5,165,917 A 11/1992 Zabotto
5,193,918 A 3/1993 Lohrmann et al.
5,217,641 A 6/1993 Herstein
5,306,514 A 4/1994 Letton et al.
5,306,515 A 4/1994 Letton et al.
5,306,516 A 4/1994 Letton et al.
RE34,617 E 5/1994 Jandacek et al.
D348,123 S 6/1994 Wu
5,376,231 A 12/1994 Matsumoto et al.
5,389,363 A 2/1995 Snyder
D360,486 S 7/1995 Schultz
5,490,529 A 2/1996 Fitjer
5,509,742 A * 4/1996 Balzarini ..... 401/17
D370,088 S 5/1996 Burns
5,655,554 A * 8/1997 Goldberg ..... 132/314
5,794,632 A * 8/1998 Gueret ..... 132/317
5,832,942 A 11/1998 Gutberlet
5,866,434 A 2/1999 Massey et al.
D419,266 S 1/2000 Gobe
D422,748 S 4/2000 Lang
6,071,503 A 6/2000 Drechsler et al.
6,074,654 A 6/2000 Drechsler et al.
6,080,687 A 6/2000 Ishwarlal
6,139,823 A 10/2000 Drechsler et al.
6,200,045 B1 * 3/2001 Hahn et al. ..... 401/18
6,203,814 B1 3/2001 Fisher et al.
6,241,408 B1 6/2001 Lang
6,267,951 B1 7/2001 Shah et al.
6,303,105 B1 10/2001 Shah et al.
D450,888 S 11/2001 Breidenbach et al.
6,340,466 B1 1/2002 Drechsler et al.
D453,588 S 2/2002 Breidenbach et al.
D453,589 S 2/2002 Breidenbach et al.
6,450,179 B2 * 9/2002 Bengis ..... 132/297
6,464,418 B1 * 10/2002 Visser et al. ..... 401/34
6,488,427 B1 12/2002 Breidenbach et al.
6,491,902 B2 12/2002 Shefer et al.
6,500,446 B1 12/2002 Derrieu et al.
D474,341 S 5/2003 Cantone et al.
6,612,764 B2 9/2003 Dumler
6,637,963 B2 * 10/2003 Huang ..... 401/19
D482,284 S 11/2003 Cantone et al.
6,682,242 B1 1/2004 Montoli
6,702,494 B2 3/2004 Dumler
D491,810 S 6/2004 Kostow
D491,811 S 6/2004 Kostow
D497,455 S 10/2004 Lee
6,811,770 B2 11/2004 Ferrari et al.
6,827,516 B2 12/2004 Gutberlet
6,896,433 B1 5/2005 Zhang
6,979,440 B2 12/2005 Shefer et al.
6,985,879 B2 1/2006 Walker et al.
D517,243 S 3/2006 Martinez
7,077,591 B2 7/2006 Gueret
D530,857 S 10/2006 Black
7,168,875 B1 1/2007 Zhang
7,175,359 B2 2/2007 Zhang
7,186,274 B2 3/2007 Vic et al.
D542,978 S 5/2007 Bortolotti
7,210,870 B2 5/2007 Breidenbach et al.
7,226,227 B2 * 6/2007 Gueret ..... 401/18
7,241,835 B2 7/2007 O'Brien et al.
7,276,088 B2 10/2007 Huang et al.
D561,390 S 2/2008 Sugawara
D566,335 S 4/2008 Althoff et al.
D566,337 S 4/2008 Althoff et al.
D574,154 S 8/2008 Dumler et al.
D574,155 S 8/2008 Dumler et al.
D578,770 S 10/2008 Berhault
D579,208 S 10/2008 Berhault
7,438,953 B2 10/2008 Kotov et al.
D581,169 S 11/2008 Berhault
D583,506 S 12/2008 Justice
D585,600 S 1/2009 Althoff et al.
7,473,045 B2 1/2009 Dumler
D592,858 S 5/2009 Berhault
D593,330 S 6/2009 Berhault
D593,331 S 6/2009 Berhault
D598,657 S 8/2009 Berhault
D600,921 S 9/2009 Berhault
D600,922 S 9/2009 Berhault
D600,923 S 9/2009 Berhault
D615,419 S 5/2010 Owen
7,780,875 B2 8/2010 Asgari
7,842,285 B2 11/2010 Lu et al.
7,856,806 B1 12/2010 Chasman et al.
D634,478 S 3/2011 Kolas et al.
7,993,661 B2 8/2011 Arnaud et al.
8,096,306 B2 1/2012 Malvar et al.
D654,626 S 2/2012 Kolas et al.
8,323,628 B2 12/2012 Atis
8,329,147 B2 12/2012 Ansmann et al.
8,336,560 B2 12/2012 Dumler et al.
2001/0051168 A1 12/2001 Ramin et al.
2002/0071707 A1 * 6/2002 Breidenbach et al. ..... 401/171
2002/0076390 A1 6/2002 Kantner et al.
2002/0083954 A1 * 7/2002 Gavney, Jr. ..... 132/297
2002/0185148 A1 12/2002 Bengis
2002/0190336 A1 12/2002 Shimizu et al.
2003/0041870 A1 3/2003 Su
2003/0086741 A1 5/2003 Kim
2003/0095935 A1 5/2003 Chaiyawat et al.
2003/0143181 A1 7/2003 Hensen et al.
2004/0105828 A1 6/2004 Chaiyawat et al.
2004/0115232 A1 6/2004 Giroud et al.
2004/0126303 A1 7/2004 Hwang
2004/0190974 A1 * 9/2004 Cantone et al. ..... 401/25
2004/0228890 A1 11/2004 Blin et al.
2004/0234564 A1 11/2004 Blin et al.
2005/0095213 A1 5/2005 Blin et al.
2005/0176598 A1 8/2005 Bergquist et al.
2005/0186167 A1 8/2005 Ueda et al.
2005/0276779 A1 12/2005 Blin
2006/0029560 A1 2/2006 Blin
2006/0067783 A1 3/2006 Tsaur

(56) References Cited

U.S. PATENT DOCUMENTS

| | | | |
|---|---|---|---|
| 2006/0127339 | A1 | 6/2006 | Bavouzet et al. |
| 2006/0134035 | A1 | 6/2006 | Zheng et al. |
| 2006/0189554 | A1 | 8/2006 | Mumper et al. |
| 2006/0260633 | A1 | 11/2006 | Wyatt et al. |
| 2006/0275232 | A1 | 12/2006 | Chevalier |
| 2007/0020205 | A1 | 1/2007 | Blin et al. |
| 2007/0041920 | A1 | 2/2007 | Blin et al. |
| 2007/0048238 | A1 | 3/2007 | Sandewicz et al. |
| 2007/0140991 | A1 | 6/2007 | Maitra et al. |
| 2007/0274941 | A9 | 11/2007 | Blin |
| 2007/0286824 | A1 | 12/2007 | Rabe et al. |
| 2008/0000491 | A1 | 1/2008 | Bodelin |
| 2008/0014232 | A1 | 1/2008 | Arnaud et al. |
| 2008/0056807 | A1 | 3/2008 | Vintimiglia |
| 2008/0107615 | A1 | 5/2008 | Keene et al. |
| 2008/0115798 | A1 | 5/2008 | Rainey et al. |
| 2008/0124350 | A1 | 5/2008 | Mumper et al. |
| 2008/0171009 | A1 | 7/2008 | Auguste et al. |
| 2008/0226575 | A1 | 9/2008 | Hanna |
| 2008/0311063 | A1 | 12/2008 | Shah et al. |
| 2009/0010868 | A1 | 1/2009 | Ilekti et al. |
| 2009/0098170 | A1 | 4/2009 | D'Acchioli et al. |
| 2009/0142282 | A1 | 6/2009 | Kendall et al. |
| 2009/0193692 | A1 | 8/2009 | Lipczynski |
| 2009/0263658 | A1 | 10/2009 | Alberius et al. |
| 2009/0317350 | A1 | 12/2009 | Lu et al. |
| 2010/0003205 | A1 | 1/2010 | Elliott et al. |
| 2010/0003293 | A1 | 1/2010 | Elliott et al. |
| 2010/0028612 | A1 | 2/2010 | Gruber et al. |
| 2010/0068163 | A1 | 3/2010 | Lu |
| 2010/0074928 | A1 | 3/2010 | Elliott et al. |
| 2010/0152135 | A1 | 6/2010 | Blin |
| 2010/0179105 | A1 | 7/2010 | Blin et al. |
| 2011/0094533 | A1 | 4/2011 | Dempsey et al. |
| 2011/0094914 | A1 | 4/2011 | Dempsey et al. |
| 2011/0117040 | A1 | 5/2011 | Dempsey et al. |
| 2011/0117043 | A1 | 5/2011 | Dempsey et al. |
| 2011/0268490 | A1 | 11/2011 | Acierto et al. |
| 2012/0114585 | A1 | 5/2012 | Dempsey et al. |
| 2012/0269753 | A1 | 10/2012 | Rabe et al. |
| 2012/0298128 | A1 | 11/2012 | Hodgetts et al. |
| 2012/0315076 | A1 | 12/2012 | Bekele et al. |
| 2013/0012594 | A1 | 1/2013 | Hirasawa et al. |
| 2013/0056016 | A1 | 3/2013 | Guay et al. |
| 2013/0056019 | A1 | 3/2013 | Wilson et al. |
| 2013/0056020 | A1 | 3/2013 | Wilson et al. |

FOREIGN PATENT DOCUMENTS

| | | | |
|---|---|---|---|
| CN | 300856710 | | 12/2008 |
| CN | 102360418 | A | 2/2012 |
| DE | 3923731 | A1 | 1/1991 |
| EM | 000345483.0003 | | 7/2005 |
| EM | 000386388.0001 | | 11/2005 |
| EM | 000386388.0002 | | 11/2005 |
| EM | 000386388.0020 | | 11/2005 |
| EM | 000386388.0028 | | 11/2005 |
| EM | 000386388.0030 | | 11/2005 |
| EM | 000386388.0031 | | 11/2005 |
| EM | 000386388.0034 | | 11/2005 |
| EM | 000500418.0001 | | 5/2006 |
| EM | 000540869.0021 | | 7/2006 |
| EM | 000540869.0024 | | 7/2006 |
| EM | 000603808.0002 | | 11/2006 |
| EM | 000623202.0002 | | 12/2006 |
| EM | 000623202.0004 | | 12/2006 |
| EM | 000623202.0009 | | 12/2006 |
| EM | 000623202.0010 | | 12/2006 |
| EM | 000623202.0011 | | 12/2006 |
| EM | 000623202.0012 | | 12/2006 |
| EM | 000623202.0013 | | 12/2006 |
| EM | 000614706.0001 | | 1/2007 |
| EM | 000654272.0003 | | 4/2007 |
| EM | 000654272.0004 | | 4/2007 |
| EM | 000654272.0005 | | 4/2007 |
| EM | 000688007.0002 | | 4/2007 |
| EM | 000688007.0003 | | 4/2007 |
| EM | 000871017.0001 | | 2/2008 |
| EM | 000871017.0007 | | 2/2008 |
| EM | 000871017.0008 | | 2/2008 |
| EM | 000871017.0009 | | 2/2008 |
| EM | 000871017.0010 | | 2/2008 |
| EM | 000871017.0014 | | 2/2008 |
| EM | 000871017.0015 | | 2/2008 |
| EM | 000871017.0016 | | 2/2008 |
| EM | 000871017.0024 | | 2/2008 |
| EM | 000871017.0025 | | 2/2008 |
| EM | 000871017.0026 | | 2/2008 |
| EM | 000871017.0027 | | 2/2008 |
| EM | 000871017.0028 | | 2/2008 |
| EM | 000871017.0029 | | 2/2008 |
| EM | 000871017.0030 | | 2/2008 |
| EM | 000871017.0031 | | 2/2008 |
| EM | 000871017.0032 | | 2/2008 |
| EM | 000871017.0033 | | 2/2008 |
| EM | 000871017.0037 | | 2/2008 |
| EM | 000871017.0038 | | 2/2008 |
| EM | 000871017.0039 | | 2/2008 |
| EM | 000871017.0040 | | 2/2008 |
| EM | 000871017.0043 | | 2/2008 |
| EM | 000871017.0044 | | 2/2008 |
| EM | 000871017.0054 | | 2/2008 |
| EM | 000871017.0055 | | 2/2008 |
| EM | 000871017.0056 | | 2/2008 |
| EM | 000871017.0057 | | 2/2008 |
| EM | 000871017.0058 | | 2/2008 |
| EM | 000871017.0059 | | 2/2008 |
| EM | 000871017.0060 | | 2/2008 |
| EM | 000871017.0061 | | 2/2008 |
| EP | 0024365 | B1 | 3/1981 |
| EP | 375856 | A2 | 7/1990 |
| EP | 384026 | A2 | 8/1990 |
| EP | 549494 | | 6/1993 |
| EP | 1238603 | A3 | 9/2003 |
| EP | 1847196 | | 10/2007 |
| EP | 1810593 | B1 | 10/2008 |
| FR | 2079785 | | 10/1971 |
| FR | 000975286.0001 | | 12/1997 |
| FR | 2841751 | A1 | 1/2004 |
| FR | 2898469 | A1 | 9/2007 |
| FR | 2905242 | A1 | 3/2008 |
| FR | 2919477 | A1 | 2/2009 |
| GB | 2124081 | A | 2/1984 |
| GB | 2293545 | A | 4/1996 |
| JP | 03173811 | | 7/1991 |
| JP | 2004-154557 | A | 6/2004 |
| JP | 2004188189 | A | 7/2004 |
| JP | 2004238363 | | 8/2004 |
| JP | 2004339212 | A | 12/2004 |
| JP | 2005-516639 | A | 6/2005 |
| JP | 2006174936 | A | 7/2006 |
| JP | 2006282585 | | 10/2006 |
| JP | 0D1207926 | | 5/2007 |
| JP | 2007-291104 | A | 11/2007 |
| JP | 2009114099 | | 5/2009 |
| JP | 2009137841 | | 6/2009 |
| JP | 20091614/80 | A | 7/2009 |
| JP | 2009-219631 | A | 10/2009 |
| KR | 300402225.0000 | | 12/2005 |
| KR | 300405136.0000 | | 2/2006 |
| KR | 300424071.0001 | | 11/2006 |
| KR | 300465977.0000 | | 10/2007 |
| KR | 300488446.0000 | | 4/2008 |
| KR | 300507379.0000 | | 9/2008 |
| WO | WO000011033.0003 | | 7/1988 |
| WO | WO000014434.0010 | | 10/1989 |
| WO | WO000014434.0011 | | 10/1989 |
| WO | WO000014434.0025 | | 10/1989 |
| WO | WO9119573 | | 12/1991 |
| WO | 96/20698 | | 7/1996 |
| WO | WO000042185.0001 | | 2/1998 |
| WO | WO000042185.0002 | | 2/1998 |
| WO | WO000042185.0003 | | 2/1998 |

(56) References Cited

FOREIGN PATENT DOCUMENTS

| | | | |
|---|---|---|---|
| WO | WO000042185.0004 | | 2/1998 |
| WO | 00/47177 | | 8/2000 |
| WO | WO000054973.0006 | | 3/2001 |
| WO | 01/45652 | | 6/2001 |
| WO | WO03020440 | | 3/2003 |
| WO | WO2004073662 | A1 | 9/2004 |
| WO | 2006/058795 | | 6/2006 |
| WO | 2006/078541 | | 7/2006 |
| WO | 2008/074870 | A2 | 6/2008 |
| WO | WO2008089926 | A | 7/2008 |
| WO | 2012/011043 | A1 | 1/2012 |

OTHER PUBLICATIONS

Avon, Avon, Shimmer Shadow and Liner, date published Jun. 2007; www.gnpd.com, 2 pages.
Avon, MistakeProof Mascara, date published Oct. 2008; www.gnpd.com , 4pages.
Bare Escentuals, bareMinerals Tutorials, Lesson 1: Get Cheeky, date published Feb. 2008; www.gnpd.com, 1 page.
Bare Escentuals, bareMinerals, Get Started: Eyes, Cheeks, Lips Set, date published Mar. 2008; www.gnpd.com, 1 page.
Bobbi Brown Copper Diamond, Everything/Lash Glamour Mascara Duo, date published Nov. 2008; www.gnpd.com, 3 pages.
Bobbi Brown, Bobbi Brown Christmas 2008, Night Sky Long-Wear Eye Palette, date published Dec. 2008; www.gnpd.com, 3 pages.
Bobbi Brown, Honey Glaze Long-Wear Eye Palette, date published Apr. 2009; www.gnpd.com, 3 pages.
Bobbi Brown, Lip and Eye Basics Palette, date published Sep. 2006; www.gnpd.com, 2 pages.
Bobbi Brown, Shimmering Nudes Collection, Shimmering Nudes Palette, date published Oct. 2008; www.gnpd.com, 3 pages.
Caboodles Color Tips, Mascara Extension, date published Dec. 2005; www.gnpd.com, 2 pages.
Cosmetobelleza Natural IM , Double Effect Mascara, date published: Jul. 2009; www.gnpd.com, 2 pages.
Creative Brands, Australis, Eyeshadow, date published Aug. 2007; www.gnpd.com, 2 pages.
Del Laboratories, Sally Hansen Healing Beauty, Thicken-Up Plumper + Mascara, date published Oct. 2003; www.gnpd.com, 2 pages.
Gurwitch Products, Laura Mercier, Limited-Edition Eye Book, date published Dec. 2008; www.gnpd.com, 2 pages.
Gurwitch Products, Laura Mercier, Beauty Library Set, date published Dec. 2006; www.gnpd.com, 3 pages.
Helena Rubinstein, Surrealist Mascara & Liner, date published Nov. 2006; www.gnpd.com, 2 pages.
Invima, Isadora Wonder Full Mascara, date published Sep. 2006; www.gnpd.com, 2 pages.
Kao, Aube Couture, Designing Double Mascara, date published Dec. 2008; www.gnpd.com, 3 pages.
Isehan, Kiss Me Mascara Remover, date published Sep. 2008; www-w.gnpd.com, 2 pages.
Kose, Fasio Easy Mascara Remover, date published Jun. 2009; www-w.gnpd.com, 3 pages.
Kose, Fasio Mascara Easy Remover, date published Jan. 2009; www-w.gnpd.com, 2 pages.
Lorac Cosmetics, Lorac, Fairytale Life Makeup Collection, date published Dec. 2007; www.gnpd.com; 4 pages.
L'Oréal Double Mascara, Date published May 2006; www.gnpd.com, 2 pages.
MAQui11AGE Shisiedo, Mascara Remover, date published Jun. 2008; wwww.gnpd.com, 2 pages.
Napoleon Perdis Cosmetics, NP Set Eyeliner, date published Mar. 2009; www.gnpd.com, 4 pages.
Napoleon Perdis Cosmetics, NP Set, Eye Palette, date published Feb. 2009 www.gnpd.com, 3 pages.
Prestige Cosmetics, Glitter Lash Mascara, date published Dec. 2008, www.gnpd.com, 2 pages.
Revlon, Limited Edition Dual Lash Mystique Mascara, date published Jun. 2003; www.gnpd.com, 1 page.
Rimmel , Coty, Volume Extend Waterproof Mascara, date published Sep. 2006; www.gnpd.com, 2 pages.
Rimmel, Double Play Multi Look Mascara, date published Apr. 2007; Mar. 2007; www.gnpd.com, 2 pages.
Rossman, Rival de Loop Young, Double Brush Mascara, date published: Oct. 2009; www.gnpd.com, 2 pages.
Shiseido, The Makeup Eraser Pencil, date published Jun. 2001; wwww.gnpd.com, 2 pages.
Sleek Makeup, Duo Dip It Mascara + Eyeliner, date published Mar. 27, 2009; www.gnpd.com, 3 pages.
International Search Report, PCT/US2011/033429, Mail date Jun. 1, 2011, 124 pages.
SmashBox Limitless Lash Mascara, date published May 2003 www-w.gnpd.com, 2 pages.
Swab Plus Eye Makeup Remover Swabs , date published Nov. 2007; wwww.gnpd.com, 2 pages.
SwabPlus Waterproof Mascara Remover Swabs, date published Dec. 2002; wwww.gnpd.com, 2 pages.
Tarte Cosmetics, Tarte Fall 2008, Eye Couture Day-to-Night Eye Palette, date published Aug. 2008; www.gnpd.com, 2 pages.
The Art of Makeup, VIP Complete Cosmetic Kit, date published Feb. 2008; www.gnpd.com 4 pages.
Narus Cosmetics, Wink Up Mascara Remover, date published Mar. 1999; wwww.gnpd.com, 1 page.
Xtreme Color, Mary-Kate and Ashley, Eye Drama Creme Eye Color Plus Rich Mascara, date published Jul. 2004; wwww.gnpd.com, 2 pages.
Yves Saint Laurent; Yves Saint Laurent Parfums; Duo Expert Sourcils, date published Nov. 2004; www.gnpd.com, 1 page.
PCT International Search Report and Written Opinion for PCT/US2013/038339 dated Sep. 12, 2013.
R. Pigeon and P. Allard, Chimie Macromo-culaire Applique, 40141 (1974), pp. 139-158 (No. 600).
PCT International Search Report and Written Opinion for PCT/US2012/038231 dated Aug. 21, 2012.
PCT International Search Report and Written Opinion for PCT/US2013/041135 dated Nov. 8, 2013.
PCT International Search Report and Written Opinion for PCT/US2010/054090 dated Feb. 16, 2012.
PCT International Search Report and Written Opinion for PCT/US2010/054089 dated Feb. 16, 2012
PCT International Search Report and Written Opinion for PCT/US2010/054085 dated Feb. 23, 2012.
PCT International Search Report and Written Opinion for PCT/IB2008/050102 dated Jun. 9, 2008.
PCT International Search Report and Written Opinion for PCT/US2010/054079 dated Feb. 23, 2012.
PCT International Search Report and Written Opinion for PCT/US2011/057104 dated Feb. 21, 2012.
R.E. Lobnig et al., "Development of a new experimental method to determine critical pigment-volume-concentrations using impedance spectroscopy", Progress in Organic Coatings 55 (2006) 363-374.
J. Jachowicz et al., "The effect of the amphiprotic nature of human hair keratin on the adsorption of high charge density cationic polyelectrolytes", Colloid and Polymer Science 263: 847-858 (1985).
S.H.M. Gibson et al., "Determination of the critical pigment volume contrations of pigmented film coating formulations using gloss measurement", International Journal of Pharmaceutics 45, (1988) 245-248.
F. Zulli et al., "Preparation and properties of small nano particles for skin and hair care", SOFW Journal 123, Jahrgang 13/97 p. 880-885.
Masaki Okazaki et al., "Introduction of cationic groups onto carbon black surface and their dispersibility in water", J. Dispersion Science and Technology 21(5), 511-524 (2000).
U.S. Appl. No. 13/894,665, filed May 15, 2013, Hodgetts et al.

* cited by examiner

PACKAGE FOR MULTIPLE PERSONAL CARE COMPOSITIONS

CROSS REFERENCE TO RELATED APPLICATIONS

This application claims the benefit of U.S. Provisional Application No. 61/329,753, filed Apr. 30, 2010.

FIELD OF THE INVENTION

The present invention is directed to a package for two or more liquid personal care compositions.

BACKGROUND OF THE INVENTION

Double-ended personal care compositions that include two applicators are generally known in the art. In some instances, the two applicators are used interchangeably with two reservoirs of product, which creates a potential problem of one or both compositions being contaminated. In addition, consumers may be confused about which applicator goes with which reservoir. This is not desirable, especially when the compositions serve non-interchangeable purposes, or are meant to be used sequentially. Even if a dual-ended product comprises only one applicator, the above risks are still present. At least some consumers, when presented with a double-ended package and only one applicator, assume that the applicator should be used for both compositions.

A specific example of this problem exists with the case of a double-ended mascara package. The removal of mascara generally requires the use of a solvent to remoisten and soften the previously applied mascara. The solvent is typically supplied as a liquid to be applied to a cotton swab or tissue. Such a cosmetic liquid may also be referred to as an eye makeup remover or simply as mascara remover. Very recently, mascara packages are available on the market comprising a mascara composition in one end and a mascara remover composition in the other end. Such packages have a composition reservoir and applicator system on both ends. Applicants have found that it is undesirable to mix and match the two compositions; for instance, the remover composition can be transferred to and dilute the mascara composition, the remover composition may degrade the mascara applicator, etc.

Accordingly, it would be desirable to provide a cosmetic package for containing two or more different liquid cosmetic composition and at least one applicator that reduces or eliminates the likelihood of contaminating one of the liquid cosmetic compositions with another.

SUMMARY OF THE INVENTION

In order to provide a solution to the problems above, disclosed herein is package for two or more liquid personal care compositions. The package comprises an applicator; a first reservoir; and a second reservoir. The first reservoir holds a quantity of a first liquid composition therein. The first reservoir includes a first reservoir proximal end and an opposing first reservoir distal end. The first reservoir proximal end comprises an open end through which the applicator is inserted and removed, and the first reservoir distal end defines a closed end of the package. The second reservoir holds a quantity of a second liquid composition therein. The second reservoir comprises a second reservoir proximal end and an opposing second reservoir distal end. The second reservoir proximal end comprises a closed end, and the second reservoir distal end comprises an open end through which the second liquid cosmetic composition is dispensed. The applicator is non-removably connected at and extends away from the second reservoir closed end, and the first reservoir is removably attached to at least one of the applicator and the second reservoir and extends away from the second reservoir closed end to protectively encase the applicator.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

As used herein, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. All ranges are inclusive and combinable. All percentages and ratios used herein are by weight of the total composition, and all measurements made are at 25° C., unless otherwise designated. The present packages can comprise, consist of, and consist essentially of the features described, as well as any of the additional or optional ingredients, components, steps, or limitations described herein.

"Cosmetic composition" means a composition that is intended to be applied to a bodily surface to improve one or more aesthetic characteristics of that bodily surface. Cosmetic compositions suitable for use herein are described in more detail below, including nonlimiting examples of cosmetic compositions.

"Non-removable" and variations thereof mean that an element is not intended to be separated from another element without damaging or impairing the intended function of the either element.

"Removable" and variations thereof mean that an element is intended to be separated from another element without damaging or impairing the intended function of either element.

Figures 1, 2, 3, 4:
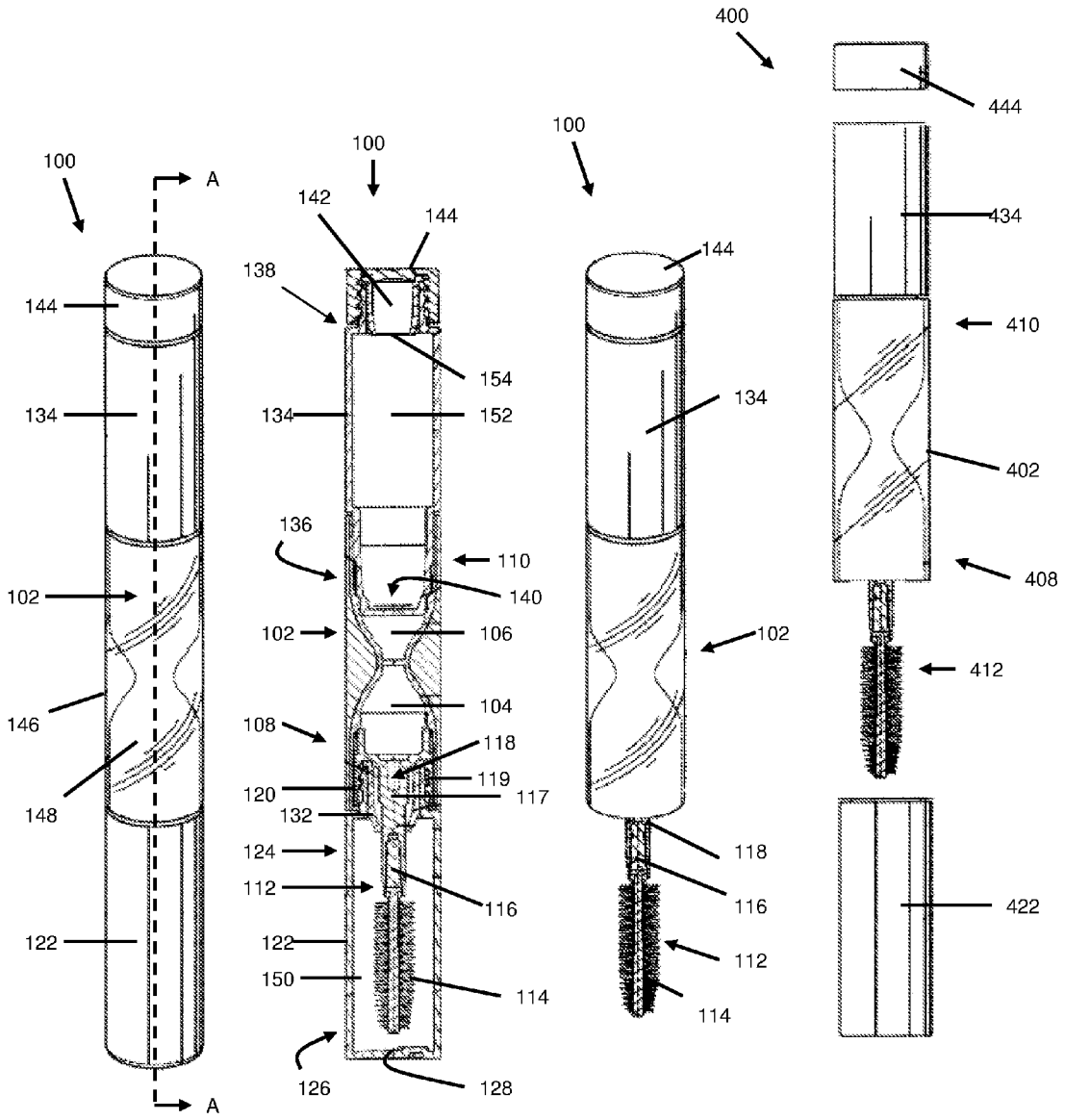
FIG. 1 is a perspective view of a package.
FIG. 2 is a section view of the embodiment shown in FIG. 1.
FIG. 3 is a perspective view of the embodiment shown in FIG. 1 without the first reservoir.
FIG. 4 is a front exploded view of the embodiment shown in FIG. 1.

FIG. 1 shows an exemplary package 100. The package 100 shown in FIG. 1 is cylindrically shaped and includes a main body 102, a first elongated reservoir 122, a second elongated reservoir 134, and a cap 144. It is to be appreciated that the package or one or more components of the package may be configured in any suitable shape, as desired (e.g., triangular, square, bulbous, tapered, wide, narrow, short, tall, or combinations thereof). For example, the first elongate reservoir may be cylinder-shaped and the second reservoir square-shaped. The package or individual package components may be made of any suitable material known in the art for making cosmetic packages. Suitable materials include plastic materials such as, for example, high density polyethylene, low density polyethylene, polyethylene terephthalate, polypropylene, polyvinyl chloride, polycarbonate, nylon, polymethylmethacrylate, polycyclohexylenedimethylene terephthalate, and fluorinated ethylene propylene. In certain embodiments, the main body 102, reservoirs 122, 134, and/or cap 144 may include transparent, semi-transparent, translucent, or opaque materials, which permit, partially permit, or prevent a user from seeing the contents of one or both reservoirs. In this example, a user may be able to readily determine how much composition remains in a reservoir 122, 134 simply by looking through a transparent or translucent portion of the package 100. In certain embodiments, the outer surface 146 of main body 102 may be transparent, which allows an inner opaque portion 148 (here, shaped as an hourglass) to be visible. In this example, the reservoirs 122, 134 and cap 144 may be opaque, transparent, or translucent.

FIG. 2 shows the package 100 of FIG. 1, along line A-A. As seen in FIG. 2, the main body 102 may include a first cavity 104 and a second cavity 106 positioned at the first end 108 and second end 110 of the main body 102, respectively. The package 100 may include an applicator 112 joined to and extending from the first cavity 104. In certain embodiments, applicator 112 may be removably or non-removably connected to the first cavity 104, for example, with a commonly known "snap-fit" mechanism. Removable connected applicators may be suitable, for example, as disposable or task-specific applicators. As shown in FIG. 2, the applicator 112 may include a mascara brush 114 connected to a stem 116, which may be joined to or integrally formed with a threadpart 118. The threadpart 118 may be formed with a stem portion 117 and a hood portion 119. In a particularly suitable embodiment, the threadpart 118 is formed separately and then non-removably joined to the applicator 112. For example, the stem portion 117 may be permanently joined to the stem 116 of the applicator by any suitable means known in the art and form a part thereof. The hood portion 119 of the threadpart 118 may be configured to be snapably and lockably engageable with the first cavity 104, for example, by providing complementary protruding and/or recessed portions (e.g., ribs and/or grooves) on the threadpart 118 and/or first cavity 104. In the example shown in FIG. 2, the hood portion 119 of the threadpart 118 includes threads 120, which are engageable with complementary threads on the first reservoir 122. In certain embodiments, the first reservoir 122 may include a neck that extends upwardly from its proximal end 124. The neck may include threads that are engageable with the threads 120 of the threadpart 118. In other embodiments, the applicator 112 may be configured without a threadpart 118.

The first reservoir 122 may include a proximal end 124, a distal end 126, and one or more walls to define an interior volume 150 for holding a quantity of liquid cosmetic composition such as, for example, mascara or mascara remover. The proximal end 124 of the first reservoir 122 is removably attached to and extends axially away from the main body 102 first end 108 to protectively encase the applicator 112. The distal end 126 of the first reservoir 122 may be configured as a closed end 128. An opening 130 may be provided in the proximal end 124 of the first reservoir 122 to permit independent insertion and removal of the applicator 112 therethrough. In certain embodiment, a wiper 132 may be provided (e.g., in and/or around the opening 130) to wipe excess liquid from applicator 112 upon removal of the applicator 112 from first reservoir 122.

The second reservoir 134 may include a proximal end 136, a distal end 138, and one or more walls to define an interior volume 152 for holding a quantity of a liquid cosmetic composition such as, for example, mascara or mascara remover. In certain embodiments, the proximal end 136 may be configured as a closed end 140 of the second reservoir 134. The second reservoir may be non-removably attached and extend axially away from the main body 102 second end 110. In certain embodiments, the second reservoir 134 may be removably connected, for example, to aide in the use of replacement reservoirs. The distal end 138 of the second reservoir 134 includes an open end 142 configured to dispense a quantity of the liquid cosmetic composition disposed therein. The second reservoir 134 may include a cap 144 for covering the open end 142. The cap 144 may be removably attached to distal end 138 by any suitable means known in the art (e.g., twist threads, snap collars, and the like). The cap 144 may be replaced after being removed to provide a liquid impermeable barrier at the open end 142 of the second reservoir 134. A wiper 154 or other flow restricting mechanism may be present in the open end 142.

The second reservoir 134 or portion thereof may be at least partially deformable to facilitate dispensing the cosmetic composition disposed therein (e.g., by permitting a user to squeeze out the contents of the reservoir). It is to be appreciated that the second reservoir or any other package 100 component may be rigid or deformable, and the contents may be shaken or poured out, as desired. In certain embodiments, the second reservoir 134 may include one or more additional dispensing means, such as a twist or push-button mechanism, which at least help to urge the cosmetic composition out of the second reservoir 134. It may be desirable to configure the second reservoir 134 for a particular dosing of its contents. While FIG. 2 does not show a second applicator, the cosmetic composition in the second reservoir 134 may be acquired and/or applied with an external implement, such as a sponge, cotton ball, cotton swab, tissue, finger, applicator brush, etc.

FIG. 3 shows the package 100 of FIG. 1 without the first reservoir 122.

FIG. 4 shows an example of a package 400, which illustrates particular components. The package 400 includes a removable first reservoir 422, a non-removable second reservoir 434, and a main body 402 disposed between the first and second reservoirs 422, 434. The package 400 includes an applicator 412 joined to the first end 408 of the main body 402 and extending outwardly therefrom. The second reservoir 434 may be non-removably joined to the second end 410 of the main body 402 such that a closed end is defined in the second reservoir 434. The second reservoir may include an open end configured to be operatively engaged with a cap 444 (e.g., through the use of screw threads), thereby forming a liquid-impermeable seal. The first reservoir 422 is engageable with a portion of the first end 408 of the main body 402 and/or the applicator 412. For example, the first reservoir 422 may include a threaded portion that extends at least partially into the interior volume of the first reservoir 422, and is engageable with a complementary portion of the applicator stem. In certain embodiments, the first reservoir may include an outwardly extending neck that includes threads engageable with a portion of the main body 402, for example, similar to the package 100 of FIGS. 1 and 2.

Figure 5:
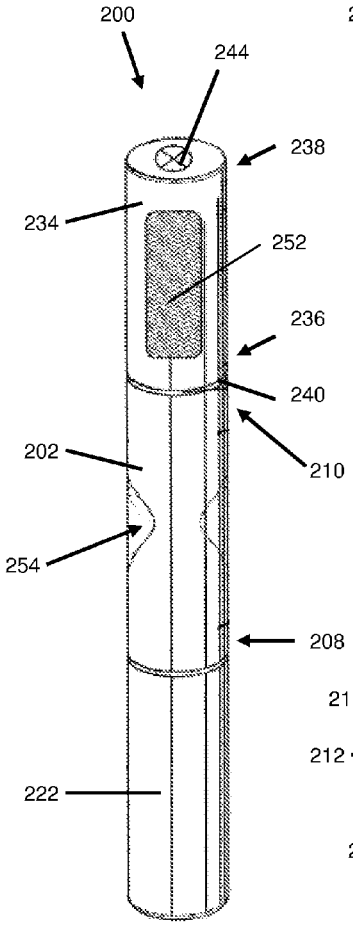
FIG. 5 is a perspective view of a package.
Figure 6:
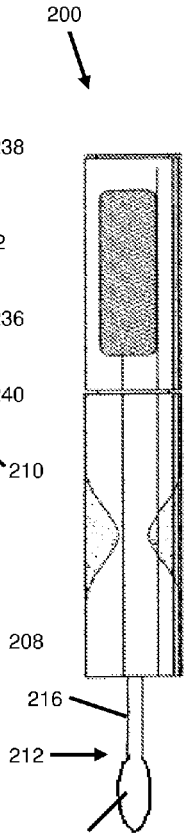
FIG. 6 is a perspective view of the front portion of the embodiment shown in FIG. 5 without the first reservoir.

FIGS. 5 and 6 show another example of package 200. The package 200 includes a main body 202, a first elongated reservoir 222, a second elongated reservoir 234, and a valve 244. The proximal end 236 of the second reservoir 234 defines a closed end 240. The second reservoir is non-removably attached to and extends axially away from the main body 202 second end 210. The second reservoir 234 may or may not comprise a cap. In certain embodiments, the contents of the second reservoir may be prevented from escaping by, for example, a built-in dispensing means near the distal end 238 of second reservoir 234. There are a variety of ways to dispense the liquid personal care composition from second reservoir 234, for instance, squeezable or measured dose. In one embodiment, the second reservoir 234 may include a depressible area 252 and a one-way valve 244, which cooperate to dispense the liquid cosmetic composition disposed in the second reservoir 234. The outer surfaces of the main body 202 and reservoirs 222, 234 may be opaque, translucent, or transparent, or any combination of these. In certain embodiments, the main body 202 may include a sticker, label, or print 254 to depict an hourglass.

FIG. 6 shows the package 200 of FIG. 5 without the first reservoir 222. The applicator includes an applicator head 214, which may be in the shape of an oval, cylinder, sphere, paintbrush, or any other suitable shape, as desired. Suitable materials for applicator head 214 include, without limitation, thermoplastic polyurethane, thermoplastic vulcanizates, rubber, sponge, felt, cloth, wicking fibers, bristles, flocking, combinations thereof, or another material or combination of materials that is capable of blending, distributing, or spreading a liquid cosmetic product. The applicator head 214 may be made from flexible and/or soft materials such as latex, rubber, TPE, sponge, and the like. The applicator 212 may also include a stem 216.

Figure 7:
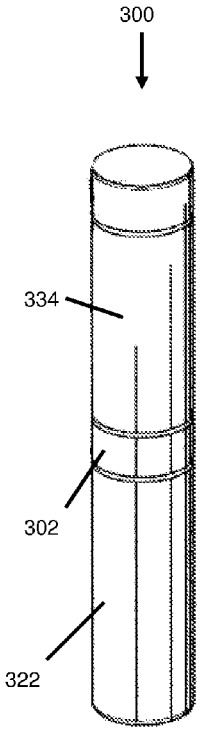
FIG. 7 is a perspective view of a package.
Figure 8A:
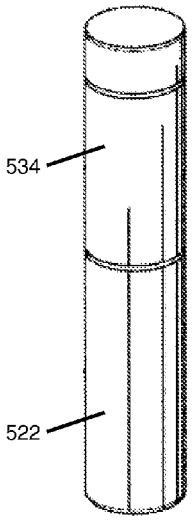
FIGS. 8*a* and 8*b* are perspective views of a package.
Figure 8B:
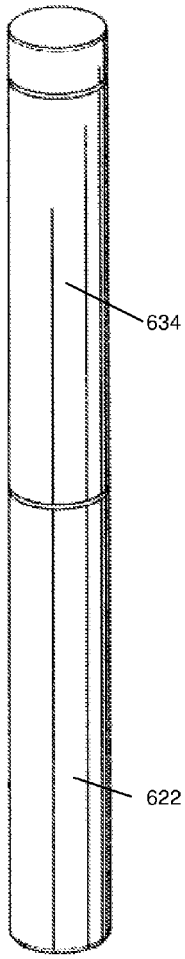

The main body may be elongated to reflect the size of the first and second reservoirs. Or, as shown in the package 300 of FIG. 7, the main body 302 may be as small as practicable to still act as a connector between the first reservoir 322 and the second reservoir 334. In other packages, as shown in FIGS. 8*a* and 8*b*, the main body may be formed integrally with the second reservoir 534, 634 and/or the first reservoir 522, 622, which may give the appearance of no middle main body. In still other packages, there may be no main body at all. In another embodiment, the package looks like a traditional mascara package with two ends/two compartments and no separate cap; in this case, the applicator is associated with the proximal end of the second reservoir, and the proximal end of the first reservoir is removably connected to the proximal end of the second reservoir.

The packages herein may contain two or more different liquid compositions. Exemplary compositions include, but are not limited to, cosmetic compositions (e.g., mascara, lip stick, lip gloss, blush, concealer, eyeliner, finishing sealant), hair growth compositions, hair removal compositions (e.g., wax or serum), a hair minimizing composition, semi-permanent ink (e.g., for tattooing, cosmetic, or personal adornment), nail polishes, skin care compositions (e.g., under eye moisturizer, anti-aging serum, sunscreen, protective balm), first aid compositions (e.g., liquid bandage, hydrocortisone, cleansing agent, antibiotic ointment), medicinal compositions (e.g., prescription acne treatment, post-surgery ointment, oral medicine for teething or mouth pain), teeth whitening compositions, hair colorant compositions (e.g., for highlighting, root covering, or novelty), and combinations thereof. Other exemplary compositions include compositions formulated to remove, modify, complement, or supplement one or more compositions in the preceding sentence (e.g., nail polish remover, mascara remover).

In certain embodiments, the package herein may be used to apply a first liquid composition as well as remove the first liquid personal care composition with a second liquid composition. In certain embodiments, the present package may be used to apply a first liquid composition and a second, complementary liquid composition. In certain embodiments, the present package may be used for two chemically incompatible liquid compositions; wherein the package is configured to prevent mixing or contamination of the two compositions.

EXAMPLES

The following are examples of suitable compositions.

Example I a multichromatic, liquid foundation of the present invention is prepared as follows:

| Material | Weight % |
|---|---|
| Colored crosslinked gel network*[1] | 40.00 |
| Dimethicone copolyol crosspolymer (KSG21) | 5.00 |
| Cyclomethicone (DC245) | 19.35 |
| Propylparabens | 0.10 |
| Ethylparabens | 0.20 |
| Water | 15.00 |
| Titanium dioxide | 8.25 |
| Iron oxides | 1.75 |
| Glycerin | 10.00 |
| Benzyl alcohol | 0.25 |
| Methylparabens | 0.10 |
| Ammonium polyacrylate (Darvan 821A*[2]) | 0.12 |
| Disodium EDTA | 0.10 |

*[1]Colored gel comprising 10% pigments (titanium dioxide and iron oxides) having a 60 micron average particle size, approximately 12% polymer, and 78% cyclomethicone fluid.
*[2]Supplied by Vanderbilt.

In a suitable vessel, the water, glycerine, disodium EDTA and benzyl alcohol are added and mixed using conventional technology until a clear water phase is achieved. When water phase is clear add methylparabens and mix again until clear. Then add the ammonium polyacrylate, titanium dioxide and iron oxides and mix to disperse. Mix the resultant phase with a Silverson SL2T or similar equipment on high speed (8,000 rpm, standard head) to fully deagglomerate the pigments. In a separate vessel, add the KSG21, hydrophobic titanium dioxide and iron oxides, DC245 and the parabens. This mixture is milled using a Silverson on high speed until homogeneous. Next, the colored water phase and the colored, silicone phase are combined and milled using a Silverson on high speed until the water is fully incorporated and an emulsion is formed. Finally, a colored gel is then chosen so as to be significantly different in colour to the blend of titanium dioxide and iron oxides. This is then added and the product is mixed again using a Silverson on high speed. The resulting multichromatic, finished product is then incorporated into the appropriate package.

Example II a skin-care composition is prepared as follows:

| Material | Weight % |
|---|---|
| Phase A | |
| Water | QS (~20% total water) |
| Glycerin | 10.0000 |
| Allantoin | 0.1000 |
| Sodium Ascorbyl Phosphate | 0.10000 |
| *Vitis Vinifera* (Grapeseed) Extract | 0.02000 |
| Green Tea Extract | 0.1 |

-continued

| Material | Weight % |
|---|---|
| Propylene Glycol | 1.0000 |
| Butylene Glycol | 1.03950 |
| Benzyl Alcohol | 0.4000 |
| Matrixyl*[1] | 3.0 |
| Glycolic Acid | 3.9900 |
| Triethanolamine | 1.0000 |
| Sodium Hydroxide | 1.1250 |
| Phase B | |
| Water | QS (~80% total water) |
| d-Panthenol | 0.5000 |
| Hydroxyethylcellulose | 1.00000 |
| Ultrez 21*[2] | — |
| Sepigel 305*[3] | — |
| Simulgel I-NS 100*[4] | — |
| Simulgel EG*[5] | — |
| Sepiplus 600*[6] | — |
| AxCel CDG-PX*[7] | 0.10000 |
| After Mixing Phase A into Phase B, add: | |
| Colorona Aborigne Amber*[8] | 0.02000 |

*[1]Anti-aging peptide solution from Sederma, Inc., Edison, NJ.
*[2]Acrylates/C10-30 alkyl acrylate crosspolymer from Noveon Consumer Specialties, Cleveland, OH.
*[3]Polyacrylamide and C13-14 Isoparaffin and Laureth-7 from SEPPIC, Inc., Fairfield, NJ.
*[4]Hydroxyethyl acrylate/sodium acryloyldimethyl taurate copolymer and isohexadecane and polysorbate 60 from SEPPIC, Inc., Fairfield, NJ.
*[5]Sodium acrylate/sodium acryloyldimethyl taurate copolymer and isohexadecane and polysorbate 80 from SEPPIC, Inc., Fairfield, NJ.
*[6] Hydroxyethyl acrylate/sodium acryloyldimethyl taurate copolymer and isohexadecane and polysorbate 60 from SEPPIC, Inc., Fairfield, NJ.
*[7]Mixture of microfibrous cellulose, xanthan gum, and sodium carboxymethylcellulose from CP Kelco, San Diego, CA.
*[8]Mica coated with iron oxide, iron oxide black, and titanium dioxide from EMD Chemicals, Inc., Gibbstown,NJ.

Phase A materials are blended in a container. Phase B materials are blended in a separate container. Phase B is blended into Phase A. The platelet particulates are added after combining Phase A and Phase B.

Example III a long wear mascara composition is prepared as follows:

| Phase | Material | Weight % |
|---|---|---|
| A | Tall Oil Glycerides | 8.000 |
| A | Pentaerythrityl Hydrogenated Rosinate | 12.00 |
| A | Trihydroxystearin | 2.500 |
| A | Propylparaben | 0.100 |
| A | BHA | 0.100 |
| A | Phenoxyethanol 99% | 0.800 |
| A | Petroleum Distillates | 57.50 |
| B | Disteardimonium Hectorite | 5.000 |
| C | Propylene Carbonate | 2.500 |
| D | Black Iron Oxide | 5.500 |
| E | Encapsualted Blue Pigment | 6.000 |

Phase A ingredients are melted and mixed together with low shear mixing. Phase B is gradually added to the Phase A and then dispersed with high shear mixing. Phase C is then added and mixed in with high shear mixing. The Phase D is then added and dispersed with high shear mixing. The batch is cooled to ambient conditions and the Phase E is added and mixed in.

Example IV a mascara containing large wax particles and fibers is prepared as follows:

| Phase | Raw Material | Weight % |
|---|---|---|
| A | Glyceryl Monostearate | 5.250 |
| A | Black Iron Oxide | 4.250 |
| A | Disteardimonium Hectorite | 2.250 |
| A | Stearic Acid | 2.750 |
| A | Carnauba Wax | 2.000 |
| A | Triethanolamine | 1.750 |
| A | Synthetic Wax | 1.500 |
| A | Polyvinyl Alcohol | 1.500 |
| A | Propylene Carbonate | 0.750 |
| A | Lecithin | 1.250 |
| A | Oleic Acid 80% | 1.000 |
| B | Acrylates Copolymer | 5.170 |
| B | Deionized Water | 42.58 |
| B | Simethicone Emulsion 30% | 0.200 |
| C | Xanthan Gum | 0.6 |
| C | Propylene Glycol | 3.000 |
| D | Ammonium Acrylates Copolymer | 17.79 |
| E | Ethyl Alcohol SD 40-B | 1.000 |
| E | Benzyl Alcohol | 0.650 |
| E | Panthenol | 0.280 |
| E | Phenoxyethanol | 0.280 |
| E | Methylparaben | 0.200 |
| E | Ethylparaben | 0.200 |
| E | Propylparaben | 0.100 |
| E | Trisodium EDTA | 0.100 |
| F | Fiberlon 102 DC B2 | 0.600 |
| G | 20 μm Polyethylene Wax Particle | 3.000 |

Phase A is heated to melt the waxes and allow the pigment to be dispersed with a Cowles Blade mixer. Phase B materials are stirred together at ambient conditions, and Phase C materials are stirred together at ambient conditions and then it is added to Phase B (to gel Phase B), and the mixture is stirred and then heated to about 85C. The Phase A and Phases B/C are mixed together to create an oil (wax) in water emulsion. The mixture is stirred for 15 minutes and then is cooled gradually till room temperature. During the cool down, Phases D and E are added to the mixture and stirred in below 60C. Phase F is a 10 Decitex 2 mm Nylon-6 polymerized with Carbon Black (D&C Black No. 2) fiber added and mixed to homogeneity. Phase G is spherical polyethylene wax particles that are prepared separately using typical process known in the art such as spray drying. Phase G is added to and mixed with the mascara once the mascara has cooled down to about 25C.

Example V an eye makeup remover:

An eye makeup remover comprising Mineral Oil, Isopropyl Palmitate, Polyethylene, Ceteth 20, Trihydroxystearin, Sorbic Acid, Methylparaben, Vanillin, and Titanium Dioxide; an example is COVERGIRL CLEAN Remover.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as “40 mm” is intended to mean “about 40 mm”

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for two liquid compositions, the package comprising:

a main body comprising a first cavity and an opposing second cavity formed into a first end and second opposing end thereof, respectively;

a mascara brush non-removably connected at and extending axially away from the first cavity;

a first reservoir holding a quantity of a liquid mascara therein, the first reservoir comprising a first reservoir proximal end and an opposing first reservoir distal end, wherein the first reservoir proximal end comprises an open end through which the mascara brush is inserted and removed, the open end being removably attached at and extending axially away from the main body first end to protectively encase the mascara brush, and wherein the first reservoir distal end defines a closed end of the package; and a second reservoir holding a quantity of a liquid mascara remover therein, the second reservoir comprising a second reservoir proximal end and an opposing second reservoir distal end, wherein the second reservoir proximal end comprises a closed end non-removably attached to and extending axially away from the main body second end, and wherein the second reservoir distal end comprises an open end through which the mascara remover is dispensed; wherein the package does not include a second applicator.

2. The package of claim 1, wherein the mascara comprises a tall oil glyceride.

3. The package of claim 1, wherein the mascara comprises pentaerthrityl hydrogenated rosinate.

4. The package of claim 1, wherein the mascara comprises wax particles.

5. The package of claim 1, wherein the mascara comprises disteardimonium hectorite.

6. The package of claim 1, wherein the mascara comprises a wax.

7. The package of claim 1, wherein the mascara comprises glyceryl monostearate.

8. The package of claim 1, wherein the mascara remover comprises mineral oil.

9. The package of claim 1, wherein the package further comprises a cap removably attached to the second reservoir distal end.

10. The package of claim 1, wherein the second reservoir is deformable to facilitate dispensing the mascara remover.

11. The package of claim 1, wherein the second reservoir is rigid.

12. The package of claim 1, wherein the second reservoir further comprises a depressible area and a one-way valve which cooperate to dispense the mascara remover from the second reservoir.

13. The package of claim 1, wherein the package further comprises a wiper in communication with the main body and extending axially away from the first cavity.

14. The package of claim 1, wherein the package further comprises a wiper in communication with the second reservoir distal end.

15. The package of claim 1, wherein the package further comprises at least one of a translucent and a transparent portion that permits a user to see how much of at least one of the mascara and the mascara remover is present.

* * * * *